US005505906A

United States Patent [19]

Engström et al.

[11] Patent Number: 5,505,906

[45] Date of Patent: Apr. 9, 1996

[54] CLEANING OF HIGH TEMPERATURE HIGH PRESSURE (HTHP) GASES

[75] Inventors: Folke Engström; Juhani Isaksson, both of Kotka, Finland

[73] Assignee: A. Ahlstrom Corporation, Karhula, Finland

[21] Appl. No.: 708,207

[22] Filed: May 31, 1991

[51] Int. Cl.[6] ..... F27B 15/00; B09B 3/00; F23J 3/00

[52] U.S. Cl. ..... 422/145; 422/146; 422/147; 122/4 D; 110/216

[58] Field of Search ..... 422/145, 147, 422/146; 122/40; 55/302, 341.7, 523; 110/216, 245

[56] References Cited

U.S. PATENT DOCUMENTS

| | | | |
|---|---|---|---|
| 4,343,632 | 8/1982 | Margraf | 55/341.7 |
| 4,415,343 | 11/1983 | Margraf | 55/379 |
| 4,468,240 | 8/1984 | Margraf | 55/294 |
| 4,747,852 | 5/1988 | Engstrom | 55/1 |
| 4,869,207 | 9/1989 | Engstrom et al. | 122/4 D |
| 5,032,143 | 7/1991 | Ritakallio | 23/313 FB |
| 5,069,171 | 12/1991 | Hansen et al. | 122/4 D |
| 5,091,156 | 2/1992 | Ijas et al. | 422/146 |

FOREIGN PATENT DOCUMENTS

| | | | |
|---|---|---|---|
| 2743805 | 4/1979 | Germany | 55/341.7 |

OTHER PUBLICATIONS

"Young Uni–Cage Horizontal Filter–Collectors" Bulletin P–652H by The Young Machinery, Co., Inc.

*Primary Examiner*—Robert J. Warden
*Assistant Examiner*—Christopher Y. Kim
*Attorney, Agent, or Firm*—Nixon & Vanderhye

[57] ABSTRACT

Apparatus for cleaning high temperature, high pressure gases includes a pressure vessel, and a filtration unit within the pressure vessel. The filtration unit is adapted to communicate with a fluidized bed reactor gas outlet, and includes at least one dirty gas chamber housing a plurality of porous, ceramic filter tubes, and at least one clean gas chamber for receiving clean gas from the ceramic filter tubes. The dirty gas chamber includes a particle outlet for removing particles separated from the gas by the filter tubes. The porous ceramic filter tubes are horizontally oriented within the filtration unit or housing and mounted within water cooled walls of the housing. The fluidized bed reactor and associated cyclone separator may be located within the pressure vessel with the filtration unit, or located outside the pressure vessel and in communication with the filtration unit inside the pressure vessel.

34 Claims, 3 Drawing Sheets

FIG. 2
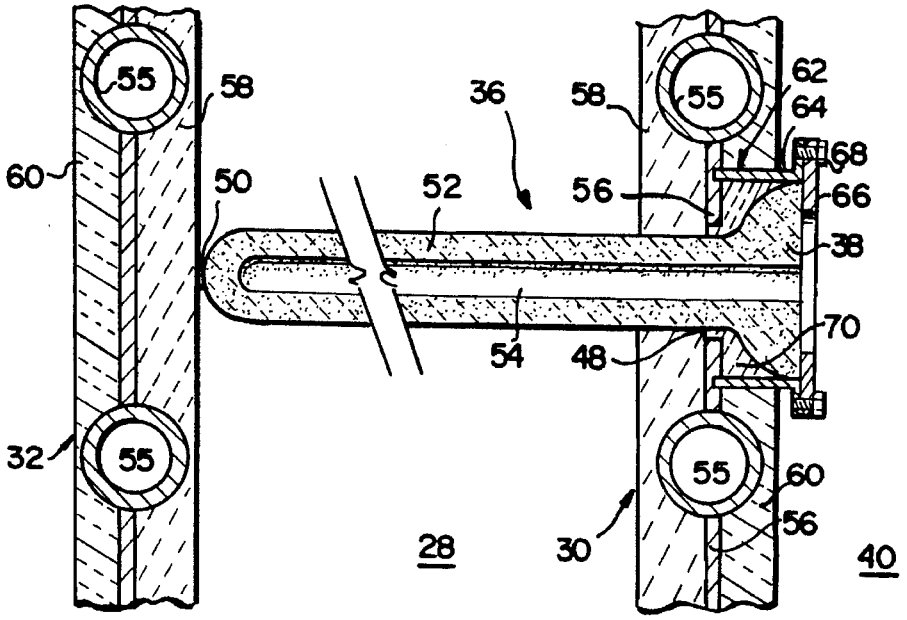
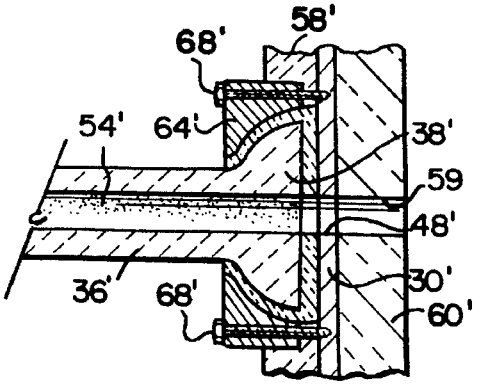
FIG. 2A
FIG. 5
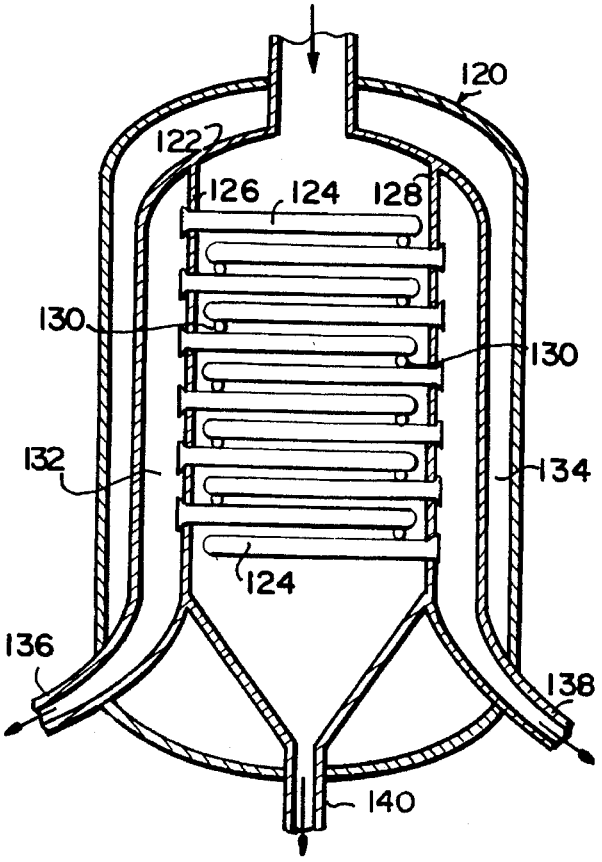

CLEANING OF HIGH TEMPERATURE HIGH PRESSURE (HTHP) GASES

The present invention relates to cleaning of high temperature, high pressure gases in a pressurized fluidized bed combustor or gasifier system.

BACKGROUND OF THE INVENTION

Highly efficient particulate removal from hot gas streams is important in various process applications including, for example:

advanced Combined Cycle Systems where High Temperature/High Pressure (HTHP) combustion gases must be efficiently cleaned before they are introduced into gas turbines;

gasifiers where HTHP process gases must be efficiently cleaned before further processing;

Hydrocarbon processing where gas streams must be cleaned, and catalysts removed from the off gases and recovered; and waste incineration processes where high quality clean-up of emissions is required.

Current HTHP cleaning technology has a number of deficiencies rendering, e.g. an effective adaptation of Advanced Combined Cycle Systems (incorporating steam as well as gas turbines) for power generation expensive, complicated and unreliable. It has been suggested to utilize two stages of refractory lined cyclones in pressure vessels to remove dust from the exhaust gases, in order to minimize the dust content to a level sufficiently low to preclude erosion of the gas turbine. Very fine dust escapes separation in cyclones, however, and flows with the exhaust gases through the gas turbine. Final clean-up of the combustion gases to regulatory particulate limits (for emissions) is accomplished by conventional electrostatic precipitation in a non-pressurized location downstream of the gas turbine. This cleaning system is not completely satisfactory as the gas entering the gas turbine may still contain abrasive particles which may cause damage to turbine components. The system is further rather complicated and space consuming, and leads to larger and more costly pressure vessel constructions.

It has also been suggested to use HTHP Ceramic Filters in pressure vessels for cleaning of hot exhaust gases. See, for example, commonly assigned U.S. Pat. No. 4,869,207 and commonly assigned application Ser. No. 07/574,550, now allowed. The above identified patent and patent application are related to filtration housings with candle type or Asahi type porous ceramic filter tubes supported vertically by horizontal cooled or non-cooled support plates. The size of the filtration housing is limited when using this type of arrangement, i.e., the diameter of the tubes cannot be increased beyond about 2–4 m. The tubes are preferably also fixedly supported at both ends which can cause problems with the sealing of the tubes to the support plates. Temperature and expansion differentials may also cause difficulties.

When using candle type filter tubes, the solids are separated on the outside of the filter tubes, whereas with Asahi type tubes, the solids are separated on the inside of the tubes. Both types are periodically cleaned by high pressure reverse air or gas pulses. A major limitation of the present HTHP filter technology, however, is the scale-up of the units to larger capacities.

The candle type filter housing units are built as refractory lined vessels, and the support plates are made of steel or castable refractories. The size of the filter housing is presently limited by construction considerations, i.e., the practical limit for the diameter of a pressure vessel with candle type filters is about 2–3 m. It is therefore not possible to scale up the filter unit and increase the filtration area simply by adding additional filters, as an increase in the number of filter tubes would require a scale up of the pressure vessel itself due to the increase of the required support plate area. The filtration velocity is presently limited to about 10 cm/s.

In an Asahi type filter, in which filter tubes in a refractory lined pressure vessel normally are vertically supported by a cooled support plate, the diameter of the filter housing is also restricted by construction factors to a max of 2–4 m. It is difficult to build large water cooled support plates having a diameter >2 m, due to expansion of the refractory lined vessel and due to the required rigidity of the support plate.

Filtration housings themselves have been previously made with refractory lined, non-cooled walls. There may have been several reasons for not cooling the walls of the housings:

there has been little practical knowledge of water cooled walls in pressurized surroundings;

there may have been a concern for water getting into the HTHP system; and the cooling of walls of a housing inside a pressure vessel may have been considered too complex.

Filtration housings have also been made as separate pressurized vessels, with the inside of the housing insulated. The insulation, however, has had to be very thick, e.g., 300 mm or so. A water cooled filtration housing could not be pressurized, however, as a separate pressure vessel since it would not survive the high pressure.

The low filtration area per filter housing volume is also a drawback of the present HTHP filters. The filter units are relatively small, corresponding to a max 40 megawatt (MW) power plant. Scale up of a power plant requires an increased number of filter housings or filter units, and consequently, for normal size power plants of 300 MW, at least 8 filter units are required. Utility power plants having a size range 100–500 MW will always need an increased number of filter units.

The combination of two or more filter units in a stacked or side-by-side arrangement leads to a very space consuming design and also complicates the configuration of HTHP ductwork to and from the filtration housings, both for gas and solid streams. As a result, the system is very costly and susceptible to failures and other problems. The stacking of several filtration chambers also leads to expansion problems in the combined construction.

Arranging several smaller filtration chambers beside each other in a pressure vessel would also be costly. The size of a pressure vessel pressurized to >5 bar is very crucial to the total cost of the system, and therefore the pressure vessel should be kept as small as possible, and the equipment inside the vessel should be arranged in as compact an arrangement as possible.

It is known from other technological areas to use horizontal filters open only at one end, as shown in U.S. Pat. No. 4,468,240 by Margraf or U.S. Pat. No. 4,046,526 by Phillippi. These filters are not related to high temperature or high pressure filtration units, however, and do not have cooled filtration housing walls.

It is an object of the present invention, therefore, to provide a HTHP ceramic filtration unit for pressurized combustion, gasification or related processes to overcome the aforementioned problems and to furnish an inexpensive, simple and reliable HTHP clean-up system.

SUMMARY OF THE INVENTION

In accordance with the present invention, there is provided generally a vertical pressure vessel enclosing an HTHP ceramic filter unit including a filtration housing having water or steam cooled walls and a plurality of horizontal candle type, porous ceramic filter tubes arranged horizontally within the filtration housing, the filters being primarily supported at their open ends by openings in at least one of the water or steam cooled walls of the filtration housing.

In one exemplary embodiment, the pressure vessel also encloses a fluidized bed reactor, which may be a combustor, gasifier or some other reactor producing hot exhaust gases. The fluidized bed reactor may have a fast or circulating fluidized bed (CFB), slow or bubbling fluidized bed. A CFB reactor also includes a first particle separator for separating the circulating bed particles entrained by the exhaust gases and discharged from the upper part of the reactor chamber, and a return duct for recirculating the separated bed particles to the lower part of the reactor chamber.

In this exemplary embodiment, the HTHP ceramic filter is connected to the gas outlet of the reactor chamber in a slow or bubbling fluidized bed reactor or to the gas outlet of the first particle separator in a fast or circulating fluidized bed reactor.

In the preferred CFB reactor embodiment, the reactor chamber, first particle separator and the HTHP ceramic filter are arranged adjacent each other in the pressure vessel, so as to make the system as compact as possible.

The walls of the filtration housing are preferably constructed as water tube walls or membrane walls, wherein adjacent tubes and fins are connected by welding to form a gastight enclosure. The water walls are insulated inside and outside as described further herein. The fins between adjacent tubes in the water wall in accordance with this invention are broader than in conventional set-ups. For example, each fin may extend 60–150 mm between tubes in order to facilitate connection of a filter tube which itself may have a diameter of about 30 to about 60 mm. With fins this broad, they must be insulated in order to prevent high temperature damage, or burn-out.

It is possible to have a water cooled pressurized filtration chamber inside the pressure vessel in accordance with this invention because there are no significant pressure differences between the inside and outside of the filtration housing.

In a filtration housing provided with ceramic filter tubes there is always a risk that the ceramic tubes will crack or break due to thermal shocks. This is especially so if there are temperature variations between the supporting structures and the ceramic tubes. Moreover, when heating a refractory lined wall that is not cooled, the temperature is not as easy to control since there may be sudden temperature peaks in the metal parts, which then are connected to only one small part of the ceramic tube. A difference in temperatures along the ceramic tube may easily lead to breakage of the tube. When the walls of the filtration housing are cooled as in this invention, however, the temperature of the wall is easy to control and to predict at all times, thereby minimizing the danger of thermal shock related damage.

Other advantages arising from cooling the filtration housing walls include:

(1) expansion of the filter housing is more easily controlled;

(2) the support structure for the ceramic tubes can be more easily arranged;

(3) high temperature corrosion of the walls (e.g., by alkali salts) is prevented;

(4) the temperature in the filtration housing is lower and more easily handled; and (4) the system can be started up in a shorter time and can withstand higher temperature variations.

A gas inlet is provided preferably at the upper part of the filtration housing and the gas is arranged to flow downwards in the housing across and through a plurality of porous ceramic candle type filter tubes arranged horizontally in the housing. The filter tubes are preferably fixedly supported at their open gas outlet ends in openings in one of the fin portions of the water or steam cooled walls, or by two or more such walls. The annular gap between the filter tube and the opening in the water wall is sealed to prevent leakage of gas into the filtration housing from the surrounding pressure vessel.

The arrangement of the filter tubes within the filtration housing may be varied according to needs. For example, the tubes may have a horizontal orientation in vertical alignment; they may have a horizontal orientation with staggered vertical alignment (this arrangement conserves space); they may also have a horizontally inclined orientation so that particles are not as easily accumulated on the exterior surfaces of the filter tubes as they would otherwise be on substantially horizontal filter tubes. It will be appreciated that vertical rows of horizontally oriented tubes permits vertical expansion of the unit without having to increase the diameter of either the filtration housing or the pressure vessel.

Other arrangements are possible as well, including vertically spaced, offset horizontal rows of tubes which permit separated particles from an upper row to fall downwardly in a free space between the vertically spaced rows.

In an arrangement comprising a plurality of vertically spaced rows, it is preferable to leave, for example, every fifth or tenth row of filter tubes free in order to provide space for maintenance and/or inspection. This extra space in the filtration housing also facilitates assembly, cleaning and/or replacing of filter tubes.

The closed ends of the filter tubes are preferably movably supported by an opposite wall of the filtration housing, or by elements protruding from the opposite wall. In another exemplary embodiment, the filter tubes may be supported by a cooled partition wall arranged in the filtration housing, while in still another embodiment, the filter tubes may also be arranged to provide support for each other. The invention is not limited, however, to any specific support arrangement.

The gas outlets of the filter tubes are connected to a manifold chamber arranged adjacent the filtration housing. Dirty gas flowing into the filtration housing will flow downwardly across the filter tubes, with gas entering the filter tubes and particles separated by the filter tubes falling to a particle outlet in the lower portion of the housing. Clean gas flowing from the filter tubes into the manifold chamber is preferably discharged through a common outlet from the pressure vessel, although two or more gas outlets may be used.

Thus, in one aspect, the present invention relates to apparatus for cleaning high temperature, high pressure gases comprising: a pressure vessel; a fluidized bed reactor including a reaction chamber supported within the pressure vessel, the reactor chamber having a gas outlet; and a filtration unit within the pressure vessel in proximity to the reactor, the filtration unit having an inlet connected to the gas outlet, the filtration unit having at least one clean gas outlet and at least one dirty particle outlet.

In another aspect, the present invention relates to apparatus for cleaning high temperature, high pressure gases comprising: a pressure vessel; a filtration unit within the pressure vessel, the filtration unit adapted to communicate with a fluidized bed reactor gas outlet; the filtration unit having at least one dirty gas chamber housing a plurality of substantially horizontally oriented porous, ceramic filter tubes, and at least one clean gas chamber for receiving clean gas from the ceramic filter tubes; wherein the dirty gas chamber includes a particle outlet and the clean gas chamber includes a clean gas outlet.

Characteristic features for the invention which provide advantages over the prior known systems include:

the ceramic filter tubes are fixed on one end to a water and/or steam cooled wall while the other end is freely moving and/or supported in various ways as described further herein to thereby permit slight movement due to thermal expansion/contraction, etc.;

the ceramic filter tubes are substantially horizontally assembled between the vertical walls;

the walls are cooled to allow for an even expansion/contraction of the walls;

the porous ceramic tubes may be packed in a staggered or other compact configurations, permitting a much slimmer construction than in known units;

the invention allows for much larger filter units than present filter units which considerably reduces the cost as well as the "footprint" area of the filter. Since the HTHP filter is enclosed in a pressure vessel, the costs of a unit built according to the invention are substantially reduced, because a much higher filtration area per volume than in present HTHP filters can be achieved.

Other objects and advantages will become apparent from the detailed description which follows.

BRIEF DESCRIPTION OF THE DRAWINGS

FIG. 2 is an enlarged, detailed partial plan of a candle type filter tube and adjacent filtration housing wall of the type shown in FIG. 1;

FIG. 2A is an enlarged, detailed partial plan similar to FIG. 2 but illustrating an alternative mounting arrangement for the filter tubes in the filtration housing wall;

FIG. 5 is an end view of a filter system in accordance with a fourth exemplary embodiment of the invention.

DETAILED DESCRIPTION OF THE DRAWINGS

Figure 1:
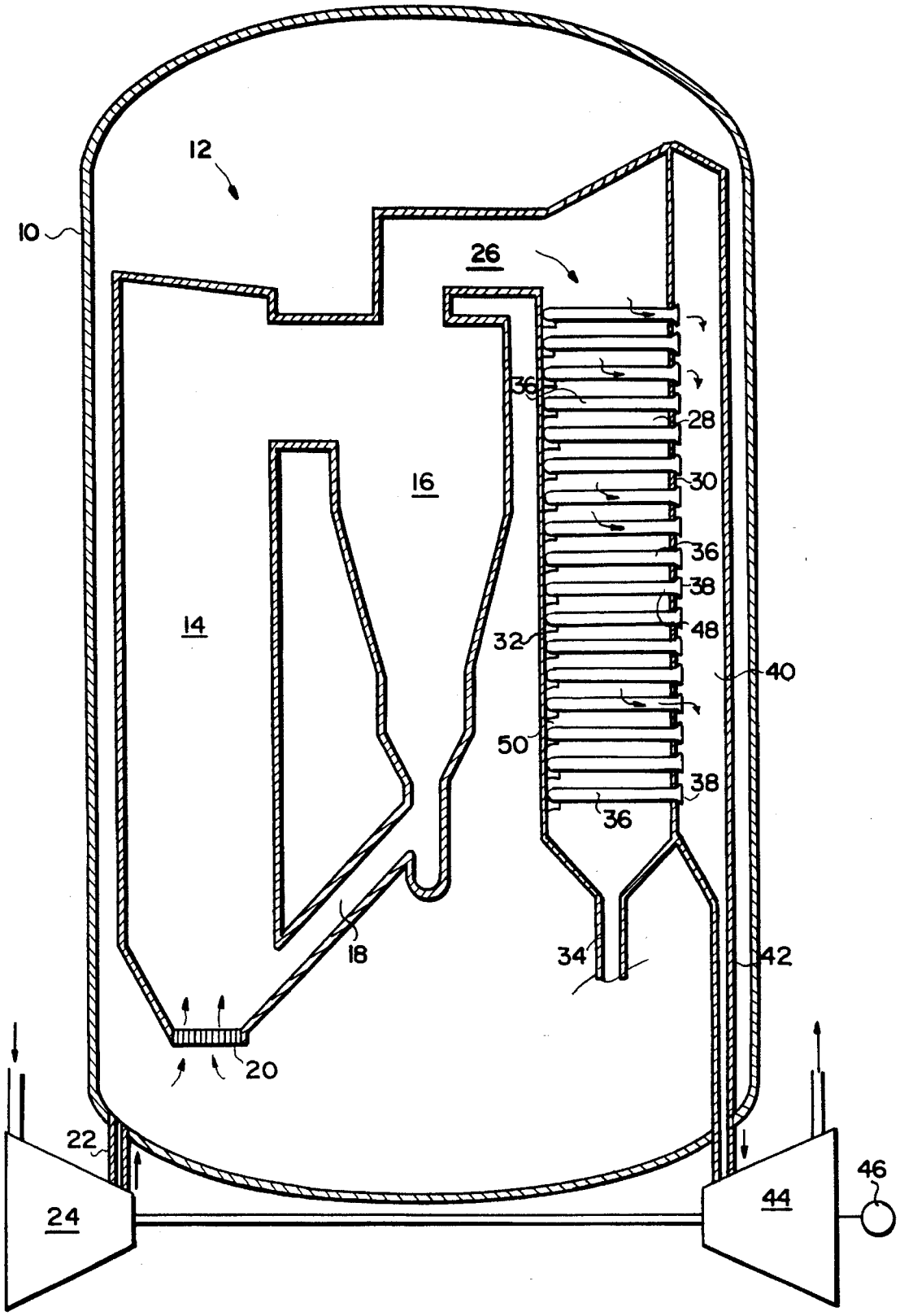
FIG. 1 is a vertical cross-sectional view of a pressurized fluidized bed/filter system in accordance with a first exemplary embodiment of the invention.

In FIG. 1, there is illustrated one exemplary embodiment of the invention, including a pressure vessel 10 supporting therein a Pressurized Circulating Fluidized Bed combustor (PCFB) 12 with a hot solids circulating system. The CFB combustor includes a reactor chamber 14, a cyclone particle separator 16 and a return duct 18. In the CFB combustor, carbonaceous material is combusted in the reactor chamber 14 with air introduced through a grid plate 20. Particles entrained with the exhaust gases are separated in the cyclone separator 16 and returned to the lower part of the reactor chamber via duct 18 in order to keep a circulating mass of solid particles in the system.

The pressure in the pressure vessel 10 is kept above 5 bar, and preferably between 5 and about 20 bar, by introducing air into the pressure vessel 10 through a duct 22 from a compressor 24. Since the pressure drop across grid plate 20 is very small, the pressure in reactor chamber 14 and cyclone 16 is also between 5 and about 20 bar.

Hot, partly cleaned exhaust gases from the cyclone separator 16 flow through an inlet duct 26 into the HTHP filtration housing or filter unit 28, having water and/or steam cooled walls 30 and 32 insulated on both sides. As explained in greater detail below, the exhaust gases are cleaned in the HTHP unit and hot particles separated are drained through duct 34 to an outlet not shown in the drawing.

In this exemplary embodiment, the filtration housing includes a plurality of horizontally arranged candle type, porous ceramic filter tubes 36 connected at their open ends 38 to a wall common to the filtration housing 28 and a manifold chamber 40. The filter tubes in one exemplary embodiment may be approximately 1–2.5 m long and have an inner diameter of about 40 mm and an outer diameter of about 60 mm. The manifold chamber 40 is connected by a duct 42 to a gas turbine 44 outside the pressure vessel.

With specific reference to FIG. 2, the candle type filters 36 which separate particulates from the exhaust gases within the filtration housing 28 are preferably porous ceramic tubes fixedly supported at their open ends 38 within openings 48 in the cooled wall 30, as described in greater detail below. The other, closed ends of the ceramic tubes 36 are supported by support elements 50 connected to the opposite cooled wall 32, although it will be understood that the ceramic tubes could be supported by the wall 32 itself.

The exhaust gas from the cyclone separator 16 flows through duct 26 into the filtration housing 28 and further downwards in the housing across and into the tubes 36 as indicated by the arrows in FIG. 1. The gas is cleaned as it flows through the porous ceramic walls 52 of the filter tubes 36, and into the hollow space or bore 54 in each of the tubes. The pressure drop across the ceramic filter tubes 36 is usually about 0.1 to about 1 bar and, therefore, the pressure in the manifold chamber 40 is slightly below the pressure in the reactor chamber 14 and filtration housing 28.

Particles separated from the gas by the filter tubes 36 flow downwards in the filtration housing 28 to the outlet duct 34, while clean gas from the filtration housing 28 is directed to the manifold chamber 40 and then introduced into the gas turbine 44 driving the compressor 44 and a generator 46. It will be appreciated that the gas will flow into the tubes 36 by reason of higher pressure in the filtration unit 28 and lower pressure in the manifold chamber 40, while the heavier particles separated by the tube filters 36 will simply fall to the bottom of the filtration housing to the outlet duct 34.

It is recognized that particles separated from the exhaust gas may clog the pores on the surface of the filter tubes 36 if not disengaged therefrom. Accordingly, reverse pulse jets may be introduced into individual filter tubes 36 from the manifold 40 (or to the whole system) in order to clean the ceramic tubes, with particles removed from the surface of each filter tube during cleaning dropping to the outlet duct 34.

As mentioned above, each filter tube 36 is supported in an opening 48 in the cooled wall 30, which, in turn, is formed by a series of water tubes 55 connected by fins 56. As mentioned above, tubes 36 may have diameters of from about 30 to about 60 mm, and fins 56 may have widths of from about 60 to about 150 mm. The openings 48 are preferably made in the fins 56 as shown in FIG. 2. The wall 30 is insulated on the inside with a wear, abrasion and heat resistant, castable refractory lining 58, preferably with a thickness of about 70–200 mm, although a thickness of between 50–150 mm may be sufficient. In many instances, the lining 58 may be provided in the form of prefabricated plates fastened with the aid of, e.g., studs (not shown) extending through the fins 56 in the wall 30.

The outside of wall 30 is insulated with a lightweight insulation material 60, such as Koawool or other porous, lightweight fiber insulation, containing, e.g., Al-oxide fibers. The outside of the wall 30 need not be as wear resistant as the inside since the gas on the outside (in chamber 40) is clean, and does not contain abrasive particles as does the inside (in housing 28).

The temperature in the water tube panel or wall 30 is relatively constant, and can be predicted and controlled during start ups and run downs, and this is advantageous when considering how the ceramic tubes 36 should be supported within the wall 30.

As best seen in FIG. 2, the outwardly flared open ends 38 of the tubes 36 are fixedly connected within the openings 48. A gasket 62 is formed around the open or outlet end 38 by means of an annular bushing 64, a flat, steel ring 66 and one or more fasteners (e.g., bolts) 68. The space inside the gasket, i.e., between the bushing 64 and flared outlet end 38 is filled with insulation material 70, which also extends between the filter tubes 36 and fins 56.

The other ends of the filter tubes 36 are movably supported by elements 50 connected to the opposite wall 32. The closed end of each filter tube 36 should be permitted to move relative to its respective support 50 as a result of, e.g., changes in temperature, and is therefore not fixed to the support. Other supporting arrangements may be employed, e.g., support elements having slots may be mounted to fins 56 into which fastening elements on the closed ends of the filter tubes can be fitted.

FIG. 2A illustrates an alternative mounting arrangement for the tubes 36 within the water cooled wall 30. In this arrangement, where similar reference numerals with "prime" designations are used to indicate corresponding components, the open end 38' of each tube 36' is fixed to the inside surface of wall 30' by annular bushing 64' via bolts 68'. The interior bore 54' of the tube 36' opens to, or is aligned with, an opening 48' in the wall 30' which, in turn, is aligned with an opening 59 in the insulation 60' so that gas flowing into the tube 36' from the housing 28' will be directed to the chamber 40.

This arrangement permits filter tubes slightly shorter in length, so that the tubes can be assembled from within the filtration housing.

It will be appreciated that the reactor 14 and separator 16 in the above described embodiment need not be located within the vessel 10 per se, but may be located outside the vessel with the inlet duct 26 connecting the separator to the filtration housing 28 inside the vessel 10.

Figure 3:
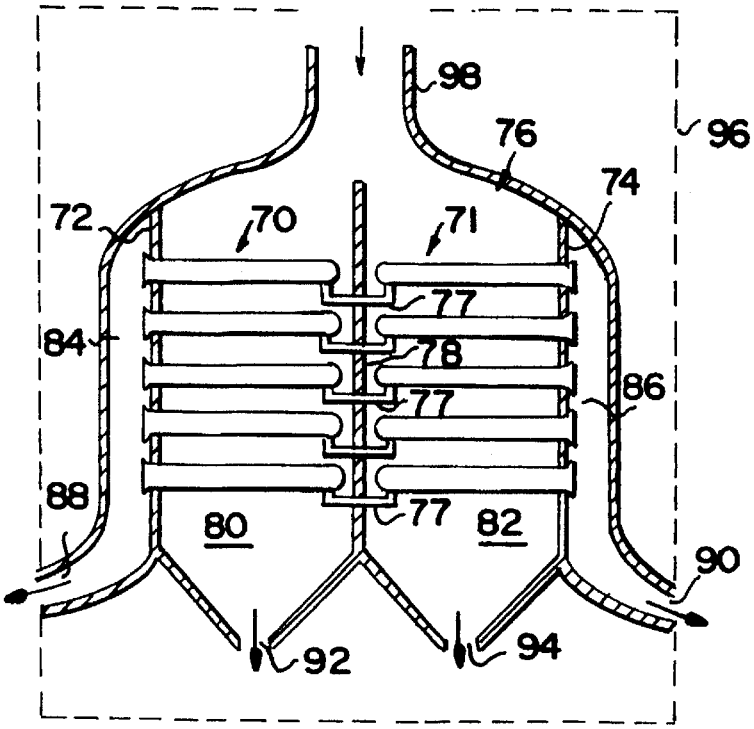
FIG. 3 is an end view of a pressurized filter system in accordance with a second exemplary embodiment of the invention.

FIG. 3 illustrates another exemplary embodiment of the invention, in which two sets 70, 71 of ceramic tubes are supported by outer, cooled walls 72, 74 of an enlarged filtration housing 76, with the closed ends of both sets of tubes supported loosely by supports 77 secured to a cooled partition wall 78. Thus, the filtration housing 76 is effectively separated into two portions 80, 82, each having a respective manifold chamber 84, 86 leading to outlets 88, 90 for clean gas. At the same time, each housing portion 80, 82 has a particle outlet 92, 94, respectively, for carrying separated particles away from the unit. It will be appreciated that outer walls 72, 74 and partition wall 78 may be constructed as tube/fin walls as in the earlier described embodiment, with similar mounting arrangements between the porous ceramic tubes and the respective walls.

The filtration housing 76 is mounted within a pressure vessel 96 (shown in phantom), and dirty gas is fed into the housing 76 through a single inlet 98. This inlet may be connected to an outlet duct from a cyclone separator and reactor (similar to 16, 14 in the FIG. 1 embodiment) mounted within the pressure vessel 96, i.e., located "behind" the housing 76, or it may be connected to a separator and reactor located outside the pressure vessel. Otherwise, the operation of the filtration housing is similar to the earlier described embodiment.

Figure 4:
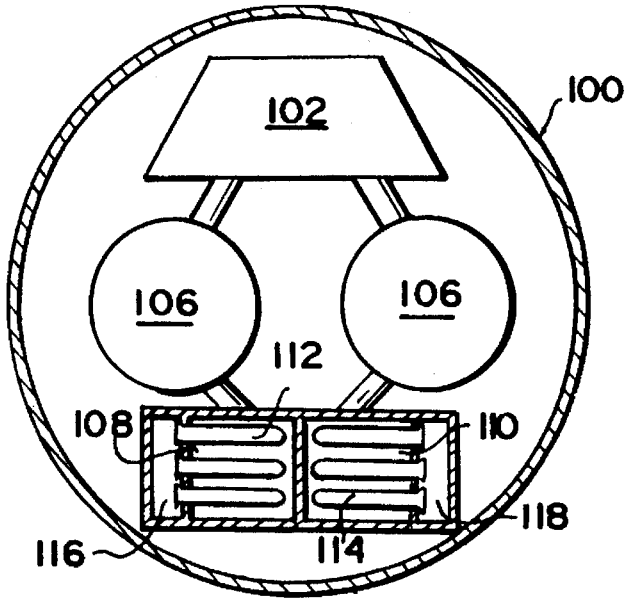
FIG. 4 is a plan view of a pressurized fluidized bed/filter system in accordance with a third exemplary embodiment of the invention.

FIG. 4 illustrates a third embodiment of the invention wherein a pressure vessel 100 encloses a reactor 102 from which exhaust gases flow to a pair of cyclone separators 104, 106 which separately feed gas to a pair of adjacent filtration housings 108, 110, respectively. The housings 108, 110 have filter tubes 112, 114, respectively, arranged in horizontal rows (a plurality of such horizontal rows are vertically aligned but not shown). The filter tubes communicate with manifold chambers 116, 118 and are otherwise structurally and functionally similar to the above described embodiments.

FIG. 5 shows a fourth exemplary embodiment of the invention, in which a pressure vessel 120 encloses a filtration housing 122 in which the candle type filter tubes 124 are vertically aligned in a more compact configuration. Specifically, the tubes 124 are alternatively supported from opposite walls 126, 128 of the filtration housing 122. The free or closed ends of each filter tube is supported by the fixed end of the tube directly underneath, via a support element 130. In this way, the enlarged open ends of the filter tubes 124 do not prevent the stacking of the filter tubes close to each other in the compact arrangement shown. In this embodiment, a pair of separate clean gas chambers 132, 134 are formed on either side of the filtration housing, with clean gas outlets 136, 138 respectively. Particles separated from the gas fall to a single outlet 140 in the lower portion of the housing. The unit shown in FIG. 5 operates in a manner similar to the above described embodiments.

As in the previously described embodiments, an associated reactor/separator may or may not be enclosed within the vessel 120.

The membrane wall can be formed of either vertical or spiral arranged tubes.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Apparatus for cleaning high temperature, high pressure gases comprising:

a pressure vessel;

a fluidized bed reactor including a reaction chamber supported within said pressure vessel, said reactor chamber having a gas outlet;

a filtration unit within said pressure vessel, said filtration unit located proximate to said fluidized bed reactor, said filtration unit having an inlet connected to said gas outlet, said filtration unit having at least a first outlet for gas free of particles and at least a second outlet for particles; and said filtration unit comprising:

a housing defined by walls, said walls provided with cooling means;

a plurality of tubes mounted substantially horizontally within said housing, each of said tubes having a hollow interior;

said tubes each having a closed end and an open end, said open end mounted in an opening in a first of said walls;

a manifold chamber;

said manifold chamber located within said pressure vessel but exterior of said housing;

said tubes having porous surfaces which separate particles from gases flowing through the housing, wherein the particle free gases flow into said manifold chamber; and wherein said open end of each of said tubes is supported in said opening by an insulated bushing.

2. Apparatus according to claim 1 wherein the fluidized bed reactor is a bubbling fluidized bed reactor.

3. Apparatus according to claim 1 wherein the fluidized bed reactor is a circulating fluidized bed reactor.

4. Apparatus according to claim 3 wherein a cyclone separator is interposed between the gas outlet of the reactor chamber and the inlet of the filtration unit.

5. Apparatus according to claim 1 wherein said porous surfaces comprise a ceramic material.

6. Apparatus according to claim 1 wherein said closed end of each of said tubes is supported by an element extending from an opposite one of said walls, said element permitting movement of said tube.

7. Apparatus according to claim 1 wherein said closed end of each of said tubes is supported by an element extending from an opposite one of said cooled walls, said element permitting movement of said tube.

8. Apparatus according to claim 1 wherein said manifold chamber is connected via a duct to a gas turbine.

9. Apparatus according to claim 1 wherein said walls forming said first gas chamber comprise a plurality of water tubes interconnected by fins.

10. Apparatus according to claim 1 wherein said ceramic filter tubes are mounted at first ends thereof to fins of one of said walls separating said gas chambers.

11. Apparatus for cleaning high temperature, high pressure gases comprising:

a pressure vessel;

a filtration unit within said pressure vessel;

a fluidized bed reactor gas outlet;

said filtration unit connected to said fluidized bed reactor gas outlet;

a plurality of porous, ceramic filter tubes;

said filtration unit comprising a housing defined by walls having associated cooling means, and having at least a first gas chamber housing said ceramic filter tubes;

at least a second gas chamber for receiving gas free of particles from said ceramic filter tubes;

said first gas chamber housing said ceramic filter tubes and including a particle outlet, said second gas chamber including a gas outlet for gas free of particles;

said cooling means comprising a plurality of tubes interconnected by fins, said tubes mounted so that they extend substantially horizontally within said housing in openings in said fins.

12. Apparatus according to claim 11 wherein walls forming said first gas chamber of said filtration unit are liquid cooled.

13. Apparatus according to claim 12 wherein said ceramic filter tubes are mounted at first ends thereof to fins of one of said walls separating said first gas and particle free gas chambers.

14. Apparatus according to claim 13 wherein said ceramic filter tubes are mounted to surfaces of said fins facing said first gas chamber.

15. Apparatus according to claim 13 wherein said ceramic filter tubes are mounted to surfaces of said fins facing said particle free gas chamber.

16. Apparatus as recited in claim 13 wherein said plurality of porous, ceramic filter tubes are mounted so that they extend substantially horizontally.

17. Apparatus according to claim 12 wherein said ceramic filter tubes are mounted at first open ends thereof, alternately, to fins of opposite walls of said first gas chamber.

18. Apparatus according to claim 17 wherein said filter tubes are substantially vertically aligned, and second closed ends of said ceramic filter tubes are supported by first open ends of ceramic filter tubes placed vertically below said second closed ends.

19. Apparatus as recited in claim 18 wherein said plurality of porous, ceramic filter tubes are mounted so that they extend substantially horizontally.

20. Apparatus according to claim 12 wherein two particle laden gas chambers and two particle free gas chambers are provided, said dirty gas chambers separated by an interior partition wall.

21. Apparatus according to claim 20 wherein said ceramic filter tubes are mounted at first ends to walls of each of said two particle laden gas chambers, with second ends of each of said ceramic filter tubes engaged by supports extending from said interior partition wall.

22. Apparatus as recited in claim 20 wherein said plurality of porous, ceramic filter tubes are mounted so that they extend substantially horizontally.

23. Apparatus according to claim 11 and wherein a fluidized bed reactor and said fluidized bed reactor outlet are located within said pressure vessel.

24. Apparatus according to claim 23 wherein at least one particle separator is disposed between said fluidized bed reactor and said filtration unit.

25. Apparatus according to claim 24 wherein a pair of particle separators are disposed between said fluidized bed reactor and said filtration unit.

26. Apparatus according to claim 25 wherein said filtration unit includes a pair of gas chambers housing said plurality of porous ceramic filter tubes, and wherein said pair of particle separators are individually connected to respective ones of said gas chambers housing said ceramic filter tubes.

27. Apparatus according to claim 26 wherein each of said pair of gas chambers is in communication with a respective clean gas chamber.

28. Apparatus as recited in claim 23 wherein said plurality of porous, ceramic filter tubes are mounted so that they extend substantially horizontally.

29. Apparatus as recited in claim 11 wherein said plurality of porous, ceramic filter tubes are mounted so that they extend substantially horizontally.

30. Apparatus for cleaning high temperature, high pressure gases comprising:

a pressure vessel;

a fluidized bed reactor including a reaction chamber supported within said pressure vessel, said reactor chamber having a gas outlet;

a filtration unit within said pressure vessel, said filtration unit located proximate to said fluidized bed reactor, said filtration unit having an inlet connected to said gas outlet, said filtration unit having at least a first outlet for gas free of particles and at least a second outlet for particles; and said filtration unit comprising:

a housing defined by walls, said walls provided with cooling means;

a plurality of tubes mounted substantially horizontally within said housing, each of said tubes having a hollow interior;

said tubes each having a closed end and an open end, said open end mounted in an opening in a first of said walls;

a manifold chamber;

said manifold chamber located within said pressure vessel but exterior of said housing;

said tubes having porous surfaces which separate particles from gases flowing through the housing, wherein the particle free gases flow into said manifold chamber; and wherein said walls are lined interiorly with abrasion and heat resistant refractory material.

31. Apparatus according to claim 30 wherein said walls are lined with fibrous insulation material.

32. Apparatus for cleaning high temperature, high pressure gases comprising:

a pressure vessel;

a fluidized bed reactor including a reaction chamber supported within said pressure vessel, said reactor chamber having a gas outlet;

a filtration unit within said pressure vessel, said filtration unit located proximate to said fluidized bed reactor, said filtration unit having an inlet connected to said gas outlet, said filtration unit having at least a first outlet for gas free of particles and at least a second outlet for particles; and said filtration unit comprising:

a housing defined by walls, said walls provided with cooling means;

a plurality of tubes mounted substantially horizontally within said housing, each of said tubes having a hollow interior;

said tubes each having a closed end and an open end, said open end mounted in an opening in a first of said walls;

a manifold chamber;

said manifold chamber located within said pressure vessel but exterior of said housing;

said tubes having porous surfaces which separate particles from gases flowing through the housing, wherein the particle free gases flow into said manifold chamber; and wherein said walls are lined with fibrous insulation material.

33. Apparatus for cleaning high temperature, high pressure gases comprising:

a pressure vessel;

a fluidized bed reactor including a reaction chamber supported within said pressure vessel, said reactor chamber having a gas outlet;

a filtration unit within said pressure vessel, said filtration unit located proximate to said fluidized bed reactor, said filtration unit having an inlet connected to said gas outlet, said filtration unit having at least a first outlet for gas free of particles and at least a second outlet for particles; and said filtration unit comprising:

a housing defined by walls, said walls provided with cooling means;

a plurality of tubes mounted substantially horizontally within said housing, each of said tubes having a hollow interior;

said tubes each having a closed end and an open end, said open end mounted in an opening in a first of said walls;

a manifold chamber;

said manifold chamber located within said pressure vessel but exterior of said housing;

said tubes having porous surfaces which separate particles from gases flowing through the housing, wherein the particle free gases flow into said manifold chamber; and wherein some of said tubes extend from said first of said walls, and others of said tubes extend from a second opposite one of said walls in a staggered array; and wherein closed ends of said tubes that extend from said first wall are supported on tubes extending from said second wall, placed below said closed 34. Apparatus for cleaning high temperature, high pressure gases comprising:

a pressure vessel;

a fluidized bed reactor including a reaction chamber supported within said pressure vessel, said reactor chamber having a gas outlet;

a filtration unit within said pressure vessel, said filtration unit located proximate to said fluidized bed reactor, said filtration unit having an inlet connected to said gas outlet, said filtration unit having at least a first outlet for gas free of particles and at least a second outlet for particles; and said filtration unit comprising:

a housing defined by walls, said walls provided with cooling means;

a plurality of tubes mounted substantially horizontally within said housing, each of said tubes having a hollow interior;

said tubes each having a closed end and an open end, said open end mounted in an opening in a first of said walls;

a manifold chamber;

said manifold chamber located within said pressure vessel but exterior of said housing;

said tubes having porous surfaces which separate particles from gases flowing through the housing, wherein the particle free gases flow into said manifold chamber; and wherein said filtration housing is substantially divided by a partition, and wherein some of said plurality of tubes extend from said one of said walls and others of said tubes extend from an opposite one of said walls, and wherein closed ends of all of said tubes are supported on one or the other side of said partition.

* * * * *